United States Patent [19]

Crane

[11] 4,277,015

[45] Jul. 7, 1981

[54] CONTAINER FOR PRODUCE AND THE LIKE HAVING RELEASABLY SECURABLE FLAPS

[75] Inventor: Walton B. Crane, Sherman Oaks, Calif.

[73] Assignee: Industrial Designs & Services, Encino, Calif.

[21] Appl. No.: 92,230

[22] Filed: Nov. 7, 1979

[51] Int. Cl.[3] ..... B65D 5/02; B65D 85/34

[52] U.S. Cl. ..... 229/23 C; 229/DIG. 4; 206/523

[58] Field of Search ..... 229/23 R, 23 C, 45; 206/523

[56] References Cited

U.S. PATENT DOCUMENTS

| | | | |
|---|---|---|---|
| 1,102,877 | 7/1914 | Clark | 229/DIG. 4 |
| 1,821,668 | 9/1931 | Ross | 229/DIG. 4 |
| 1,839,782 | 1/1932 | Andrews | 229/23 R X |
| 2,071,962 | 2/1937 | Babcock | 229/23 C |
| 2,284,942 | 6/1942 | Boeye | 229/23 C |
| 3,409,902 | 11/1968 | Belcher | 229/23 R |
| 3,629,901 | 12/1971 | Wolf | 229/DIG. 4 |
| 3,878,980 | 4/1975 | Crane | 229/34 R |
| 3,905,478 | 9/1975 | Peterson | 206/523 |
| 3,905,541 | 9/1975 | Paxton | 229/23 R |
| 3,915,372 | 10/1975 | Crane | 229/23 R |
| 4,147,289 | 4/1979 | Crane | 229/23 R |
| 4,211,358 | 7/1980 | Crane | 229/23 C |

*Primary Examiner*—Davis T. Moorhead

*Attorney, Agent, or Firm*—Fulwider, Patton, Rieber, Lee & Utecht

[57] ABSTRACT

A container for produce and the like is formed by a pair of endwalls and a wrapper. The wrapper is divided by score lines into a floor panel, a pair of sidewalls, a pair of cover flaps and a pair of joiner strips by which the flaps are connected to the sidewalls. The joiner strips permit the flaps to be shifted laterally as well as pivotally. Each flap has a tab at each end thereof that is received, when the flap is closed, in a recess between two lugs on one of the endwalls. The tabs can shift laterally as permitted by undercut portions of the recesses, and must be so shifted and then bowed before they can be withdrawn from the recesses so that the flaps can be opened pivotally.

16 Claims, 7 Drawing Figures

CONTAINER FOR PRODUCE AND THE LIKE HAVING RELEASABLY SECURABLE FLAPS

FIELD OF THE INVENTION

The present invention relates to containers for produce or the like and, more particularly, to such containers having cover flaps that can be releasably secured in closed positions.

BACKGROUND OF THE INVENTION

Produce, such as grapes, tomatoes and tree fruit, is often packed in the field in generally rectangular tray-like boxes, sometimes referred to as lug boxes. Once a box is filled, a cover is secured over it to protect the contents from contamination and prevent it from bouncing out while in transit. In some instances, the containers have cover flaps connected to their sidewalls that are folded over and secured to the endwalls by nails. Other containers have separate cover pieces that interlock with nail-like fasteners on the endwalls.

Since containers of the above type are generally used only once and are consumed by the hundreds of thousands in a single growing season, their cost must be kept to a minimum. It is also important that they be easily and quickly closed after they have been filled so as not to delay the packing operation. Once closed, they must not open during handling and they must have sufficient strength to protect the produce against degradation. The containers should be lightweight so they do not add unduly to shipping costs and should be transportable at minimum expense prior to assembly.

A principal objective of the present invention is to provide an improved, inexpensive container for produce and the like that is of simple lightweight construction, having a cover that is quickly and easily secured in a closed position without tools but will not be opened inadvertently.

SUMMARY OF THE INVENTION

The present invention resides in a container for produce and the like that includes a floor panel, sidewalls extending upwardly from the floor panel and a pair of endwalls to which the floor panel and sidewalls are attached. Cover flaps having end tabs are connected to the sidewalls by joiner strips.

When the cover flaps are closed, recesses in the endwalls receive the tabs, the recesses including undercut portions that interlock with the tabs, normally preventing opening movement of the flaps. The joiner strips, being bendably connected to the sidewalls and the cover flaps, permit both lateral and pivotal movement of the flaps to engage and disengage the undercut portions when desired. Entrance portions of the recesses are preferably dimensioned so that the tabs will not pass through them unless bowed sightly first. It is preferable that the recesses include additional undercut portions arranged to engage the tabs and prevent movement of the tabs and flaps toward open positions upon lateral movement of the tabs away from the first undercut portions.

The endwalls may be provided with upwardly projecting end and center lugs between which the recesses are defined. Preferably the lugs are equal height to provide stable stacking surfaces.

According to another aspect of the invention, the floor panel, sidewalls, joiner strips and cover flaps are all formed of a single piece of corrugated material and separated from each other by scorelines. The endwalls can be polystyrene which is lightweight and inexpensive.

Other features and advantages of the present invention will become apparent from the following detailed description, taken in conjunction with the accompanying drawings which illustrate, by way of example, the principles of the invention.

DESCRIPTION OF THE PREFERRED EMBODIMENT

Figure 1:
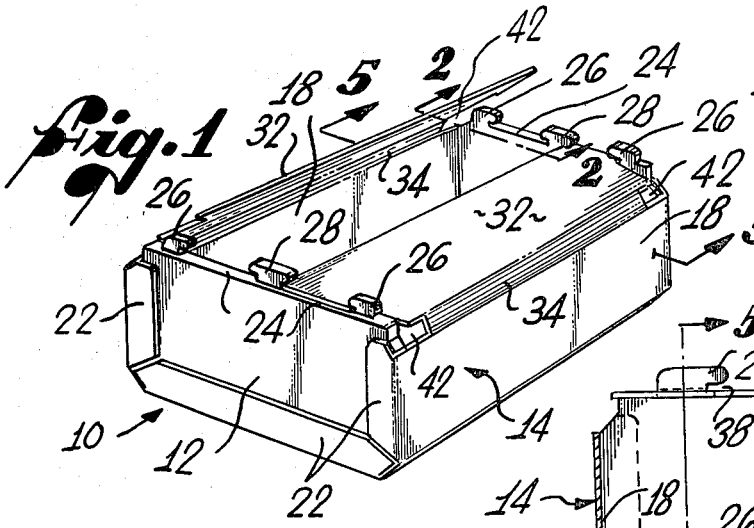
FIG. 1 is a perspective view of a produce container constructed in accordance with the present invention, one cover flap being shown in a partially open position while the other is shown in a closed position.
Figure 5A:
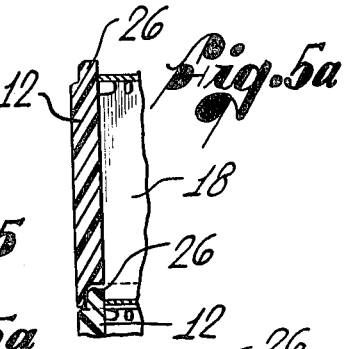
FIG. 5*a* is a fragmented vertical section taken generally along the line 5*a*—5*a* of FIG. 5.
Figure 5:
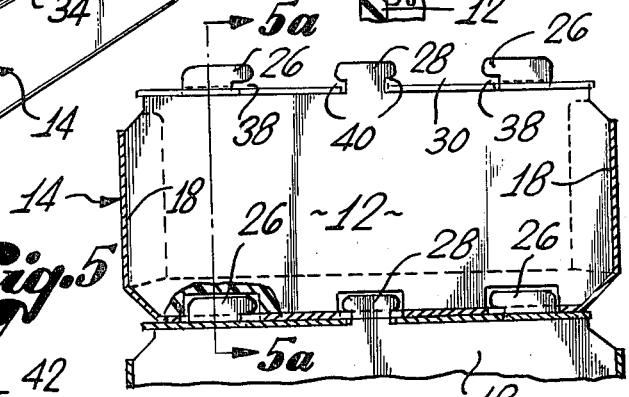
FIG. 5 is a side elevation of one endwall of the container.
Figure 2:
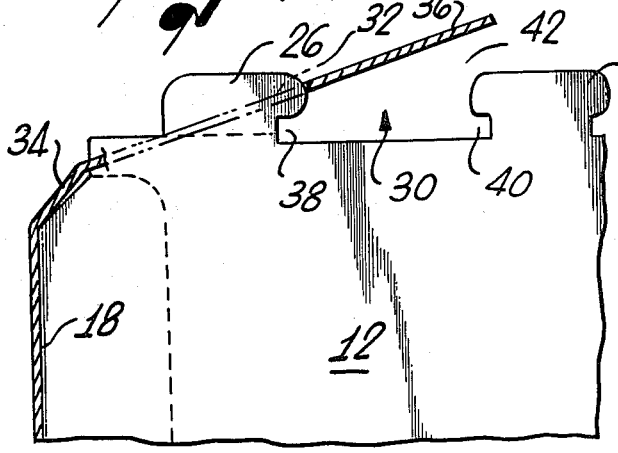
FIGS. 2, 3 and 4 are enlarged fragmentary cross-sectional views of a cover flap and a portion of an endwall taken substantially along a portion of the line 2—2 of FIG. 1.
Figure 3:
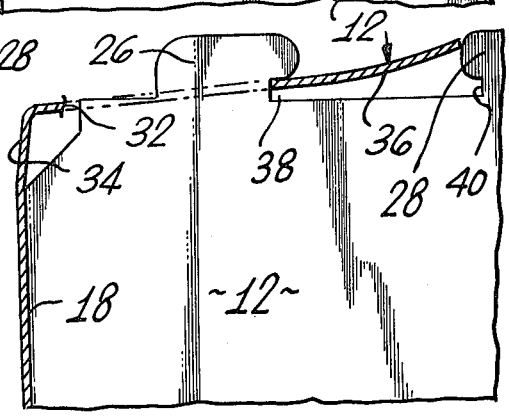
Figure 6:
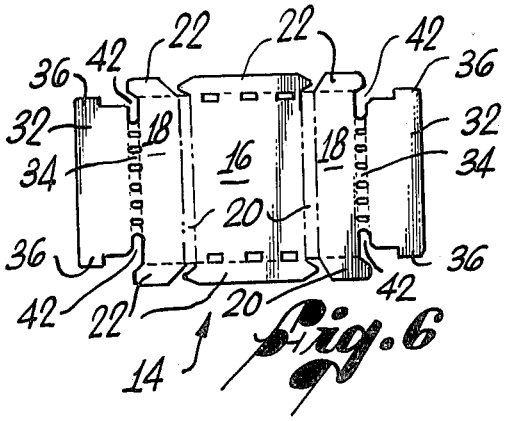
FIG. 6 is a plan view of the wrapper of the container in a unfolded condition.

An exemplary produce container 10, shown in FIG. 1, embodies the many advantages of the present invention. In general, it includes two endwalls 12, one of which is shown in FIG. 5, and a wrapper 14, shown unfolded in FIG. 6.

The endwalls 12 are generally rectangular and are rigid, being made of lightweight expanded polystyrene. They are positioned parallel to each other to form two opposite ends of the container 10.

The wrapper 14 is integrally formed of a single sheet of corrugated paperboard, the various sections of which are defined by scorelines. It includes a large central floor panel 16 and relatively narrow sidewalls extending parallel to each other along opposite sides of the floor panel. Each sidewall 18 is connected to the floor panel 16 by a narrow, elongated bevel strip 20.

When the container 10 is assembled, the sidewalls 14 are folded to extend upwardly with the bevel strips 20 forming forty-five degree angles with both the sidewalls and the floor 16 for added strength and ventilation. At each end of the container 10, attachment panels 22 that extend from the sidewalls 18 and floor 16 are folded over the outer surface of one of the endwalls 12 to which they are glued to form a rigid three-dimensional structure.

On the otherwise flat, horizontal, top surface 24 of each endwall 12 is a pair of upstanding end lugs 26 with a center lug 28 between them. All the lugs 26 and 28 are of the same height and are flat-topped so that they provide a firm support for another container of similar construction and dimensions if the containers are to be stacked. When one loaded pallet is placed on top of another, the lugs 26 and 28 of the top row of containers 10 on the lower pallet support the upper pallet. Although the lugs 26 and 28 may be compressed somewhat, there is no damage to the integrity of the containers 10 below. Each endwall 12 defines a pair of recesses 30 between adjacent lugs 26 and 28, as best shown in FIGS. 2–5. The function of the recesses 30 is to releasably secure a pair of cover flaps 32, as explained below.

Each cover flap 32 is generally rectangular and is attached to the top edge of one of the sidewalls 18 by an elongated joiner strip 34 similar to the bevel strips 20. Unlike the sidewalls 14 and the floor 16, the cover flaps 32 and joiner strips 34 are not secured directly to the endwalls 12 by attachment panels 22, and they are, therefore, free to move as the wrapper 14 bends along its scorelines. The cover flaps 32 are capable of pivoting and of moving laterally across the top of the container 10 as the connecting joiner strips 34 articulate. Outwardly projecting tabs 36 extend from the ends of the flaps 32.

Figure 4:
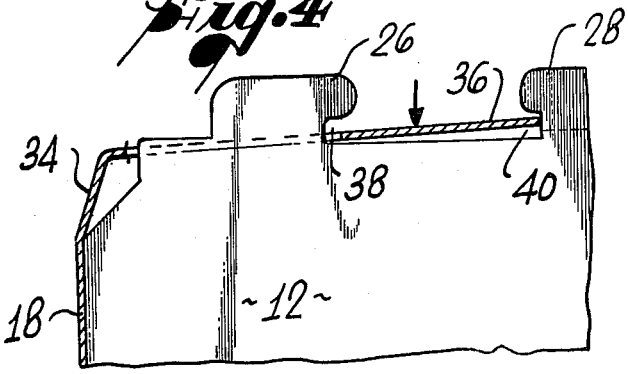

Considered first in their closed positions, as shown in FIG. 4, the flaps 32 each extend horizontally almost half way across the top of the container 10 and are received at the bottoms of the corresponding recesses 30 where they extend between the lugs 26 and 28. The width of each recess 30 is greatest at the bottom where it has two undercut portions 38 and 40, one at each end, cut into the lugs 26 and 28. Although each tab 36 can be shifted laterally between the ends of its recess 30, it is always restrained against pivotal movement by a part of at least one lug 26 or 28 that overhangs its undercut portion 38 and 40.

An entrance portion 42 of each recess 30, above the undercuts 38 and 40, is narrow, measuring slightly less than the dimension of the tab 34 (when measured along the endwall 12). Thus, while it is possible to shift the flaps 32 laterally so that the tabs 36 move within the recesses 30, the overhanging portions of the lugs 26 and 28 prevent upward pivoting of the flaps through the entrance portions 42 of the recesses 30.

Assuming that one of the flaps 32 is in its open position, as shown in FIG. 1, in which it is free of the lugs 26 and 28, it can be pivoted downwardly until the inner ends of the tabs 36 reach the tops of the corresponding end lugs 26. Simultaneously, the joiner strip 34 connected to that flap 32 is bent inwardly from the sidewall 18 so that the flap is displaced laterally toward the center of the container 10 sufficiently for the edges of the tabs 36 nearest the supporting sidewall 18 to drop down past the rounded ends of the end lugs 26 into the entrance portions 42 of the slot 30 (see FIG. 2). The other edges of the tabs 36 will not quite clear the opposing rounded ends of the center lugs 28. It is, therefore, necessary to flex or bow the ends of the flap 32 and the adjacent tabs 36 slightly (see FIG. 3), thereby reducing the lateral dimensions of the tabs just enough to allow them to pass through the entrance portions 42 of the slots 30. The joiner strip 34 does not extend the full width of the sidewall 18 and flap 32, leaving an indentation 42 at each end that facilitates flexing at the ends of the flap. When released, the flap 32 straightens out again (FIG. 4) so that it is interlocked with the lugs 26 and 28 and is secured in a closed position.

The flap 32 can be readily disengaged from the lugs 26 and 28 and moved to its open position again by reversing the above procedure. The flap 32 is shifted laterally toward the nearest sidewall 18 to the full extent permitted by the end lugs 26. It is then bowed slightly so that it will pass the center lug 28 as it is pivoted upwardly through the entrance portion of the recess 30.

It will be appreciated that the container 10 is of simple, inexpensive, lightweight construction. Nevertheless, it provides excellent protection for its contents. The cover flaps 32 can be quickly and easily secured in closed positions without any tools and can be reopened in the same manner.

While a particular form of the invention has been illustrated and described, it will also be apparent that various modifications and changes can be made without departing from the spirit and scope of the invention.

I claim:

1. A container for produce or the like comprising:

a floor panel;

a pair of sidewalls;

at least one cover flap movable between open and closed positions and having at least one end tab;

a pair of endwalls to which said floor panel and said sidewalls are attached, at least one of said endwalls having a recess on a top surface thereof to receive said tab when said flap is in said closed position, said recess including an undercut portion adapted to interlock with said tab and prevent said flap from moving toward said open position; and a joiner strip bendably connected to one of said sidewalls along one edge thereof and bendably connected to said flap along an opposite edge thereof, whereby said joiner strip permits both lateral and pivotal movement of said flap to engage and disengage said tab from said undercut portion.

2. The container of claim 1 wherein said recess includes an additional undercut portion arranged to interlock with said tab and prevent movement of said tab and flap toward said open position upon lateral movement of said tab away from said first-mentioned undercut portion.

3. The container of claim 1 wherein said flap, said joiner strip and said sidewall to which said joiner strip is connected are integrally formed of a single piece of material and are divided from each other by scorelines.

4. The container of claim 3 wherein said endwalls are plastic.

5. The container of claim 3 wherein said endwalls are formed of expanded polystyrene.

6. The container of claim 1 wherein said recess has an entrance portion of reduced lateral dimension such that said end tab must be bowed to be inserted therein.

7. The container of claim 6 wherein said joiner strip does not extend the full width of said flap, leaving an indentation at each end thereof that facilitates flexing of said flap.

8. A generally rectangular container for produce or the like comprising:

a floor panel;

a pair of parallel sidewalls extending upwardly;

a pair of cover flaps each movable between an open position and a closed position, each of said flaps having an end tab on each of two opposite ends thereof;

a pair of endwalls to which said floor panel and said sidewalls are rigidly secured, each of said endwalls having a pair of recesses that receive said tabs when said flaps are in said closed positions, said recesses having undercut portions adapted to interlock with said tabs to prevent said flaps from moving toward said open positions; and a pair of elongated joiner strips each bendably connected to one of said sidewalls along one edge thereof and bendably connected to one of said flaps on an opposite edge thereof, whereby said joiner strips permit both lateral and pivotal movement of said flaps to engage and disengage said tabs and said undercut portions.

9. The container of claim 8 wherein each of said recesses includes an additional undercut portion arranged to interlock with a corresponding one of said tabs and prevent movement of said tab toward said open position upon lateral movement of said tab away from a corresponding one of said first-mentioned undercut portions.

10. The container of claim 8 wherein said flaps, said joiner strips and said sidewalls are integrally formed of a single piece of material and are divided from each other by scorelines.

11. The container of claim 8 wherein said floor panel, sidewalls, joiner strips and flaps are integrally formed of a single sheet of corrugated paperboard and are divided from each other by scorelines.

12. The container of claim 11 wherein said endwalls are formed of expanded polystyrene.

13. The container of claim 8 wherein each of said endwalls is generally rectangular having an upwardly projecting center lug and a pair of upwardly projecting end lugs, each of said recesses being between one of said center lugs and one of said end lugs.

14. The container of claim 8 wherein each of said recesses has an entrance portion of reduced lateral dimension such that said tabs must be bowed to be inserted therein.

15. The container of claim 14 wherein each of said joiner strips does not extend the full width of the connected one of said flaps, leaving an indentation at each end thereof that facilitates flexing of said flap.

16. A generally rectangular container for produce or the like comprising:

a corrugated paperboard wrapper divided by scorelines into a floor panel, a pair of parallel sidewalls, a pair of elongated joiner strips of lesser width connected to the sidewalls, and a pair of cover flaps connected to said joiner strips, each of said cover flaps having a pair of tabs on opposite ends thereof; and a pair of expanded polystrene endwalls to which said floor panel and said sidewalls are rigidly connected, each of said endwalls having a pair of upwardly projecting end lugs and a center lug of equal height defining a pair of recesses in which said tabs can be received, each of said recesses having an entrance portion dimensioned to permit said tabs to enter said recesses when slightly bowed and a pair of undercut portions at opposite ends thereof positioned to interlock with said tabs to prevent said tabs from moving upwardly toward open positions.

* * * * *